US008638263B2

(12) United States Patent
Hansen et al.

(10) Patent No.: US 8,638,263 B2
(45) Date of Patent: Jan. 28, 2014

(54) PLATFORM ENHANCEMENTS FOR PLANAR ARRAY ANTENNAS

(75) Inventors: Christopher Hansen, Sunnyvale, CA (US); Vadim Piskun, San Jose, CA (US)

(73) Assignee: Broadcom Corporation, Irvine, CA (US)

( * ) Notice: Subject to any disclaimer, the term of this patent is extended or adjusted under 35 U.S.C. 154(b) by 326 days.

(21) Appl. No.: 13/077,210

(22) Filed: Mar. 31, 2011

(65) Prior Publication Data

US 2012/0249388 A1 Oct. 4, 2012

(51) Int. Cl.
*H01Q 19/06* (2006.01)

(52) U.S. Cl.
USPC ..... 343/753; 343/755

(58) Field of Classification Search
USPC ..... 343/753, 755, 834, 836
See application file for complete search history.

(56) References Cited

U.S. PATENT DOCUMENTS

| | | | | |
|---|---|---|---|---|
| 7,705,797 | B2 * | 4/2010 | Philippakis | 343/833 |
| 7,812,767 | B2 * | 10/2010 | Seki et al. | 343/700 MS |
| 8,208,980 | B2 * | 6/2012 | Wong et al. | 455/575.5 |
| 2007/0200764 | A1 * | 8/2007 | Cho et al. | 343/700 MS |
| 2009/0046017 | A1 * | 2/2009 | Foo | 343/700 MS |
| 2009/0096702 | A1 * | 4/2009 | Vassilakis et al. | 343/836 |

* cited by examiner

*Primary Examiner* — Ahshik Kim
(74) *Attorney, Agent, or Firm* — Garlick & Markison

(57) ABSTRACT

A technique to extend antenna coverage pattern of a planar antenna array. In one instance a reflector is disposed above the planar antenna array and in another instance a lens element is disposed above the planar antenna array. The reflection or refraction of RF signals allows antenna coverage pattern to be extended in a horizontal direction parallel to the planar surface of the antenna array and beyond a coverage pattern that is typically not available, without such reflection or refraction of the RF signal.

20 Claims, 7 Drawing Sheets

PLATFORM ENHANCEMENTS FOR PLANAR ARRAY ANTENNAS

BACKGROUND OF THE INVENTION

1. Technical Field of the Invention

The embodiments of the invention relate to planar antenna arrays and, more particularly, to the utilization of a planar antenna array to provide platform enhancements.

2. Description of Related Art

Various wireless communication systems are known today to provide links between devices, whether directly or through a network. Such communication systems range from national and/or international cellular telephone systems, the Internet, point-to-point in-home system, as well as other systems. Communication systems typically operate in accordance with one or more communication standards or protocol. For instance, wireless communication systems may operate using protocols, such as IEEE 802.11, Bluetooth™, advanced mobile phone services (AMPS), digital AMPS, global system for mobile communications (GSM), code division multiple access (CDMA), local multi-point distribution systems (LMDS), multi-channel-multi-point distribution systems (MMDS), as well as others.

For each wireless communication device to participate in wireless communications, it generally includes a built-in radio transceiver (i.e., receiver and transmitter) or is coupled to an associated radio transceiver (e.g., a station for in-home and/or in-building wireless communication networks, modem, etc.). Typically, the transceiver includes a baseband processing stage and a radio frequency (RF) stage. The baseband processing provides the conversion from data to baseband signals for transmitting and baseband signals to data for receiving, in accordance with a particular wireless communication protocol. The baseband processing stage is coupled to a RF stage (transmitter section and receiver section) that provides the conversion between the baseband signals and RF signals. The RF stage may be a direct conversion transceiver that converts directly between baseband and RF or may include one or more intermediate frequency stage(s).

Furthermore, wireless devices typically operate within certain radio frequency ranges or band established by one or more communications standards or protocols. A local oscillator generally provides a local oscillation signal that is used to mix with received RF signals or baseband signals that are to be converted to RF signals in the modulation/demodulation stage of the RF front end. A synthesizer may be used to set the frequencies to drive the local oscillator to provide the desired frequencies for mixing, in which the desired frequencies are generally based on the channel frequencies established for the particular standard or protocol.

In a typical wireless device, the RF transceiver is coupled to an antenna. In some earlier portable devices, such as cordless telephones and radios, the antenna was an elongated di-pole antenna or a loop antenna. The antenna was usually located external to the device. In more recent wireless devices, such as cellular phones, portable computers, handheld audio and/or video players, the antenna is mounted internally. For example, in notebook computers, the WiFi antenna is mounted around the display or along an edge of the computer housing. In cellular phones, the antenna is disposed along the side edge or along the top of the phone casing. Most of these antennas utilize an elongated coil or a helical coil.

Devices today that communicate short range, such as those devices that utilize 802.11 protocol or Bluetooth™ protocol, generally utilize antennas that provide omni-directional coverage so that a particular position of the devices is typically not a concern. Thus, a notebook computer utilizing one of the 802.11 protocols may be placed in a general proximity to an access point, such as a router, without regard to positioning or facing of the computer in a particular way. A headset utilizing Bluetooth protocol may be worn on a person and the associated communicating device may be placed nearby or on the person, without regard to the placement of the device or particular facing by the user. The omni-directional antenna coverage is easily obtainable using wire or coil antennas, because these devices typically use communication protocols that are within the 2-6 GHz band.

As demand for data downloads increase, newer generation devices are being developed that allow for higher data transfers. These higher data rate mobile devices will most likely use communication protocols that require a higher frequency of operation. In that instance, standard coil antennas may not provide the requisite communication linkage capability. For example, devices that utilize millimeter wave protocols in the 60+ GHz range may need to transition to an array of antennas to provide the transmission and reception capabilities. Antenna arrays allow for improved beamforming characteristics at such higher frequencies, but have the drawback in that theses arrays are typically formed on a planar substrate and may be more directional than coil type antennas. In this instance, relative positioning of the mobile device could be a concern in order to maintain a communication link with other communicating devices, if the antenna pattern generated by the planar array is restrictive.

Accordingly, there is a need to obtain larger antenna coverage pattern from an antenna, where such an antenna utilizes a planar antenna array.

SUMMARY OF THE INVENTION

The present invention is directed to apparatus and methods of operation that are further described in the following Brief Description of the Drawings, the Detailed Description of the Invention, and the Claims. Other features and advantages of the present invention will become apparent from the following detailed description of the embodiments of the invention made with reference to the accompanying drawings.

DETAILED DESCRIPTION OF THE INVENTION

The embodiments of the present invention may be practiced in a variety of wireless devices that utilize antennas arranged on a planar surface. The particular embodiments described below pertain to antenna elements disposed into an array and formed on a planar surface. However, the invention may be practiced with various types of antennas that have a flat disposition and a limited antenna pattern. Furthermore, two beam changing examples are described below in way of a reflector and a lens. However, it is to be noted that other elements or devices which change the direction of the beam to and/or from a planar antenna assembly may be employed as well in practicing the invention.

Figure 1:
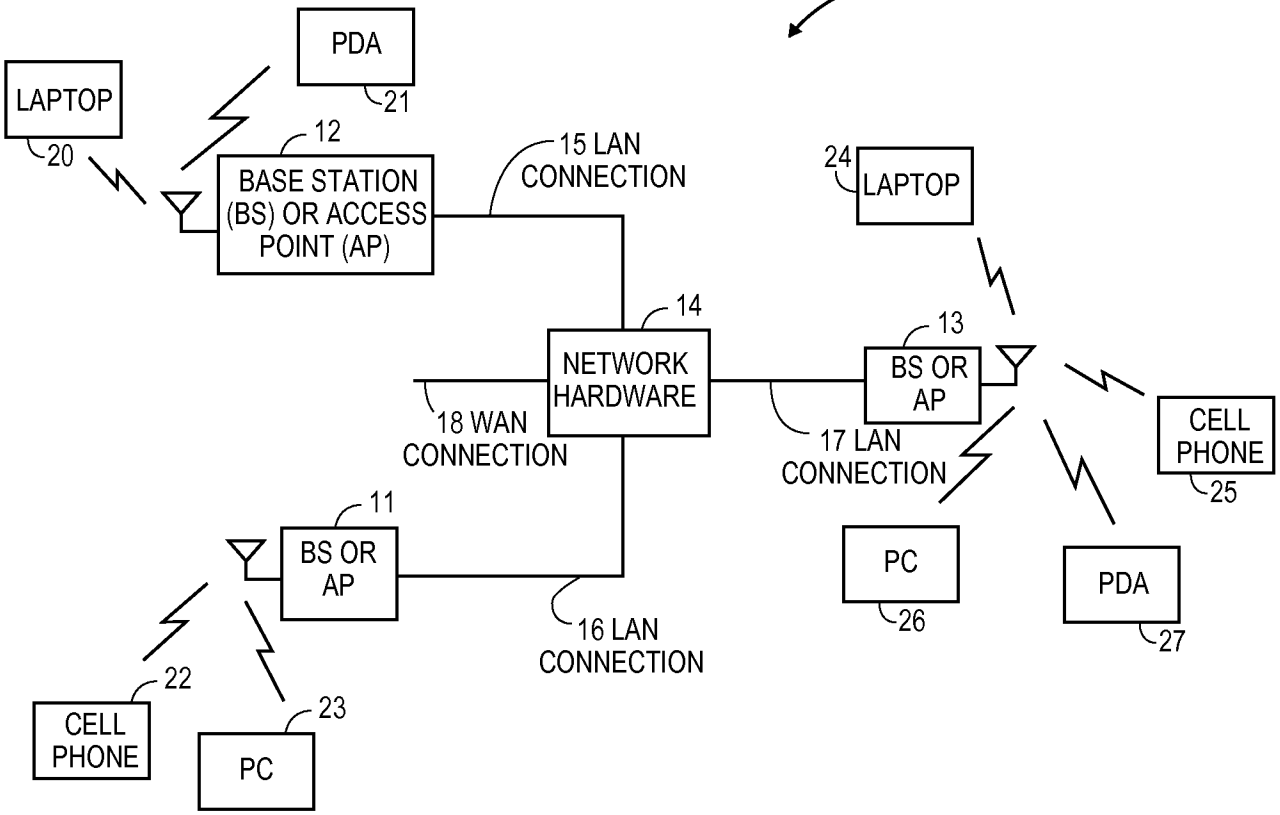
FIG. 1 is a block diagram showing a wireless communication system in accordance with one embodiment for practicing the present invention.

FIG. 1 illustrates one environment for practicing the present invention. FIG. 1 shows a communication system 10 that includes a plurality of base stations (BS) and/or access points (AP) 11-13, a plurality of wireless communication devices 20-27 and a network hardware component 14. The wireless communication devices 20-27 may be laptop computers 20 and 24, personal digital assistants 21 and 27, personal computers 23 and 26, cellular telephones 22 and 25, and/or any other type of device that supports wireless communications.

The base stations or access points 11-13 may be operably coupled to network hardware 14 via respective local area network (LAN) connections 15-17. Network hardware 14, which may be a router, switch, bridge, modem, system controller, etc., may provide a wide area network (WAN) connection 18 for communication system 10. Individual base station or access point 11-13 generally has an associated antenna or antenna array to communicate with the wireless communication devices in its area. Typically, the wireless communication devices register with a particular base station or access point 11-13 to receive services within communication system 10. For direct connections (i.e., point-to-point communications), wireless communication devices may communicate directly via an allocated channel.

Typically, base stations are used for cellular telephone systems and like-type systems, while access points are used for in-home or in-building wireless networks. Regardless of the particular type of communication system, each wireless communication device includes a built-in radio and/or is coupled to a radio. The radio includes a highly linear amplifiers and/or programmable multi-stage amplifiers to enhance performance, reduce costs, reduce size, and/or enhance broadband applications. The radio also includes, or is coupled to, an antenna or antennas having a particular antenna coverage pattern for propagating of outbound RF signals and/or reception of inbound RF signals.

Figure 2:
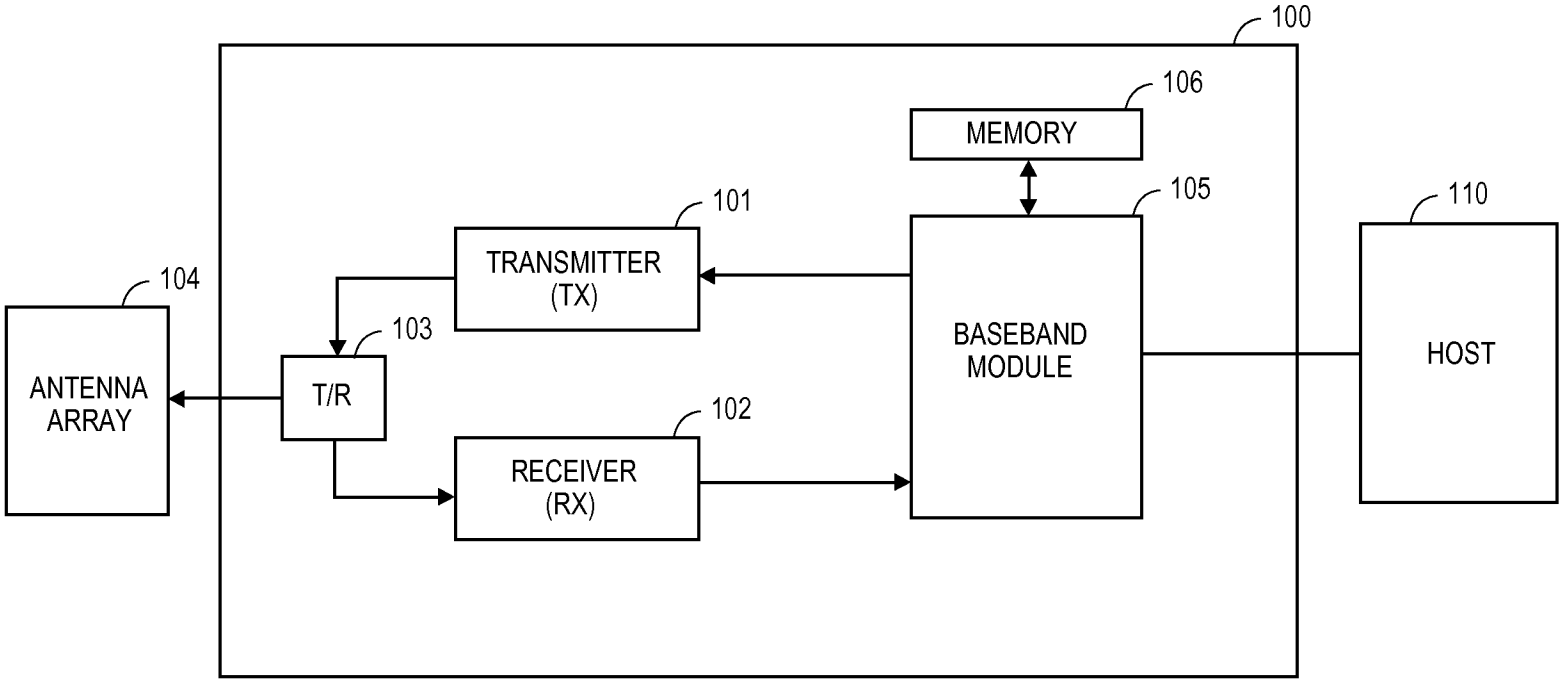
FIG. 2 is a schematic block diagram showing an embodiment of a wireless communication device for practicing the present invention, in which a planar antenna array is utilized.

FIG. 2 is a schematic block diagram illustrating part of a wireless communication device 100 that includes a transmitter (TX) 101, receiver (RX) 102 and baseband module 105. Baseband module 105 provides baseband processing operations. In some embodiments, baseband module 105 is or includes a digital-signal-processor (DSP). Baseband module 105 is typically coupled to a host unit, applications processor or other unit(s) that provides operational processing for the device and/or interface with a user. In FIG. 1, a host unit 110 is shown. For example, in a notebook or laptop computer, device 100 may represent the computing portion of the computer, while device 110 is utilized to provide WiFi and/or Bluetooth components for communicating wirelessly between the computer and an access point and/or between the computer and a Bluetooth device. Similarly, for a handheld audio or video device, device 100 may represent the application portion of the handheld device, while device 100 is utilized to provide WiFi and/or Bluetooth components for communicating wirelessly between the handheld device and an access point and/or between the handheld device and a Bluetooth device. Alternatively, for a mobile telephone, such as a smartphone, device 100 may represent the WiFi and/or Bluetooth components for the smartphone. Device 100 may also be used for cellular communication as well in some embodiments. Furthermore, device 100 may be incorporated in one or more of the wireless communication devices 20-27 shown in FIG. 1.

A memory 106 is shown coupled to baseband module 105, which memory 106 may be utilized to store data, as well as program instructions that operate on baseband module 105. Various types of memory devices may be utilized for memory 106. It is to be noted that memory 106 may located anywhere within device 100 and, in one instance, it may also be part of baseband module 105.

Transmitter 101 and receiver 102 are coupled to an antenna array 104 via transmit/receive (T/R) switch module 103. T/R switch module 103 switches the antenna array between the transmitter and receiver depending on the mode of operation. It is to be noted that in other embodiments, separate antenna arrays may be used for transmitter 101 and receiver 102, respectively.

Outbound data for transmission from host unit 110 are coupled to baseband module 105 and converted to baseband signals and then coupled to transmitter 101. Transmitter 101 converts the baseband signals to outbound radio frequency (RF) signals for transmission from device 100 via antenna array 104. Transmitter 101 may utilize one of a variety of up-conversion or modulation techniques to convert the outbound baseband signals to outbound RF signal.

Generally, the conversion process is dependent on the particular communication standard or protocol being utilized.

In a similar manner, inbound RF signals are received by antenna array 104 and coupled to receiver 102. Receiver 102 then converts the inbound RF signals to inbound baseband signals, which are then coupled to baseband module 105. Receiver 102 may utilize one of a variety of down-conversion or demodulation techniques to convert the inbound RF signals to inbound baseband signals. The inbound baseband signals are processed by baseband module 105 and inbound data is output from baseband module 105 to host unit 110.

It is to be noted that in one embodiment, baseband module 105, transmitter 101 and receiver 102 are integrated on the same integrated circuit (IC) chip. Transmitter 101 and receiver 102 are typically referred to as the RF front-end. In other embodiments, one or more of these components may be on separate IC chips. Similarly, other components shown in FIG. 2 may be incorporated on the same IC chip, along with baseband module 105, transmitter 101 and receiver 102. In some embodiments, the antenna array 104 may also be incorporated on the same IC chip as well. As described below, in one embodiment, antenna array 104 is incorporated on a substrate separate from the device 100, but the two are packaged together as one flip-chip assembly. Furthermore, with advent of system-on-chip (SOC) integration, host devices, application processors and/or user interfaces, such as host unit 110, may be integrated on the same IC chip along with baseband module 105, transmitter 101 and receiver 102.

Additionally, although one transmitter 101 and receiver 102 are shown, it is to be noted that other embodiments may utilize multiple transmitter units and receiver units. For example, diversity communication and/or multiple input and/or multiple output communications, such as multiple-input-multiple-output (MIMO) communication, may utilize multiple transmitters 101 and/or receivers 102 as part of the RF front-end. As will be described below, in one embodiment, antenna array 104 comprises a plurality of antenna elements disposed on a planar surface to form a planar antenna array structure.

Figure 3:
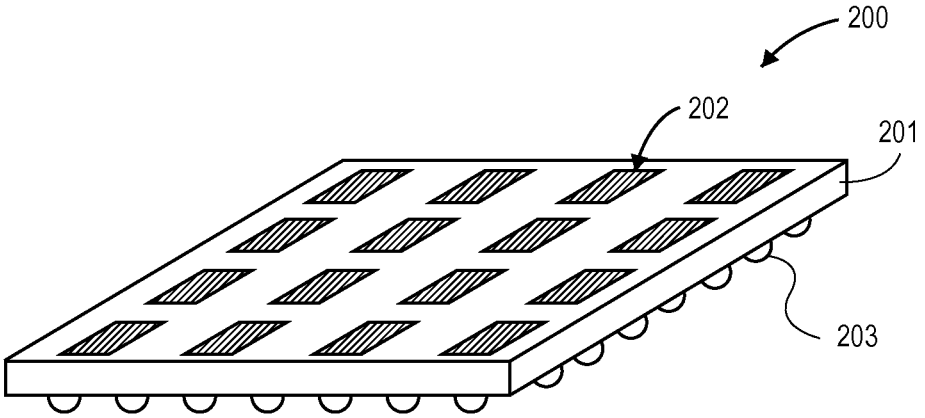
FIG. 3 is a pictorial illustration of one embodiment of a planar antenna array assembly comprised of a plurality of antennas formed on a planar surface.

FIG. 3 shows a planar antenna array 200 comprised of a plurality of antenna elements 202 disposed on a planar surface of a substrate 201. Each antenna element 202 may be fabricated utilizing a variety of techniques, including known techniques. Generally, a conductive pattern or design is disposed within or atop substrate 201 to fabricate each antenna element 202. The antenna elements 202 are then electrically coupled to a transmitter and/or receiver, such as described for antenna element 104 in FIG. 2. In the shown example of FIG. 3, sixteen antenna elements 202 are shown arranged in a 4×4 matrix. It is to be noted that other embodiments may use different number of elements and the elements may be arranged differently. In one embodiment, the sixteen antenna elements 202 are disposed on a 12 millimeter by 12 millimeter surface.

Substrate 201 is comprised of a dielectric or semi-conductive material that allows antenna elements 202 to be formed thereon. For example, in one embodiment, substrate 201 may be silicon, upon which conductive antenna elements are formed thereon. In other embodiments, the substrate may be formed from an oxide material or even a printed circuit (PC) board. The actual material that forms substrate 201 and antenna elements 202 are not critical to the practice of the present invention, suffice that a plurality of antenna elements 202 are formed on a support body, such as substrate 201, to provide a substantially planar antenna array 200 and electrical connections are provided within substrate 201 for electrical coupling of antenna array 200.

Figure 4:
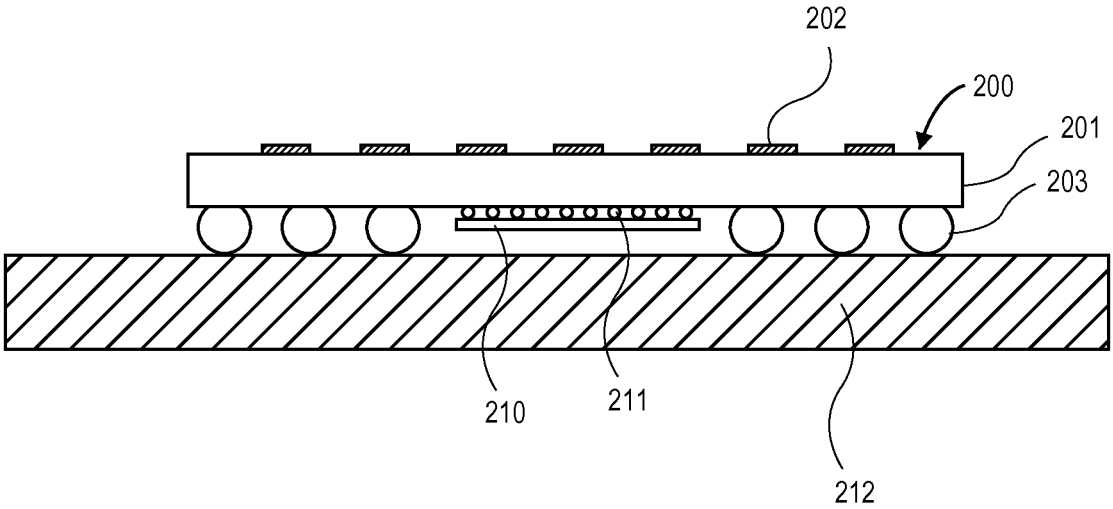
FIG. 4 is a side plan view of the antenna array assembly of Figure of 3, which is mounted on a supporting surface.

As noted in FIG. 3, in one embodiment, a plurality of attachment points or contacts 203 are shown on the underside of substrate 201. As shown in FIG. 4, attachment contacts 203 are utilized to provide a contact surface for attaching planar antenna array 200 to a supporting surface 212. A variety of designs may be employed for attachment contacts 203 to attach planar antenna array 200 to supporting surface 212.

FIG. 4 illustrates an integrated circuit (IC) 210 attached to the underside of substrate 201 opposite the side containing planar antenna array 200. IC 201 typically includes circuitry that provides the RF front end operations. In some embodiments, IC 201 may include baseband processing as well. Accordingly, in one embodiment, IC 210 may be device 100 of FIG. 2 that provides both RF and baseband processing operations. IC 210 is attached to substrate 201 and electrical connections made to substrate 201 through contacts 211. In one embodiment, ball-grid-array (BGA) designs may be used for contacts 211. In one embodiment, flip-chip technology may be used for mounting IC 210 on the underside of the planar antenna array 200.

It is to be noted that in some instances IC 210 may not be mated to substrate 201. However, for better performance characteristics, it is generally advantageous to have short transmission distance between an antenna and the RF front-end to reduce loss, noise, distortion etc., which may degrade performance. Accordingly, the example embodiment shown in FIG. 4, places device 100 proximal to planar antenna array 200, such that the electrical connection between IC 210 and planar antenna array 200 is through substrate 201. If IC 210 was placed away from substrate 201, a significantly longer path would be present for signal transmission between IC 210 and planar antenna array 200.

Figure 5:
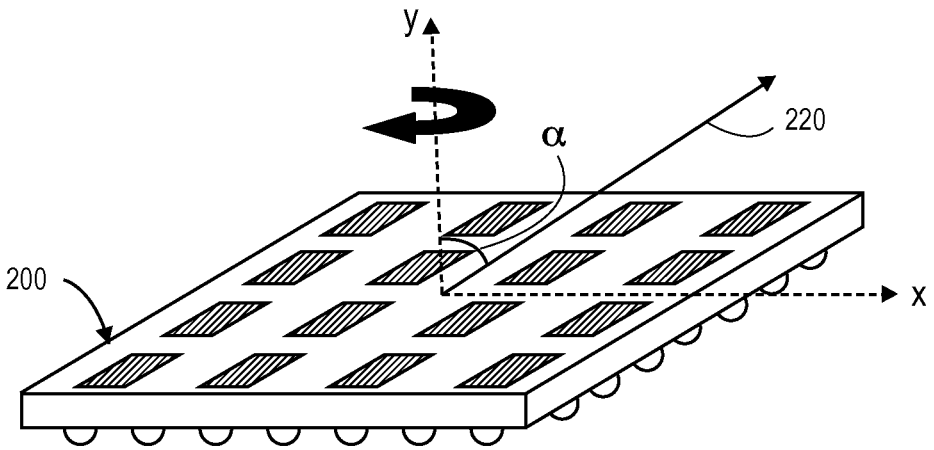
FIG. 5 is a pictorial illustration showing typical beam coverage from a planar antenna array structure.

FIG. 5 exemplifies a situation when planar antenna array 200 is in operation. Due to the nature of the planar surface, the antenna coverage pattern of planar antenna array 200 is generally in a vertical direction. The vertical direction is identified by axis Y, which is the axis normal (perpendicular) to the planar surface, upon which the antenna elements reside. Alternatively, axis X represents the horizontal direction, which is parallel to the planar surface. For a planar antenna array design, such as planar antenna array 200, the coverage or pattern provided by the array is no more than approximately 60 degrees)(60° from vertical (or zenith).

With some planar antenna arrays, the coverage may be much less. The 60° or less coverage from the vertical is illustrated by angle a in FIG. 5. The dark rotating arrow indicates that the coverage pattern is obtained 360° about the vertical. Thus, the extent of the antenna coverage does not extend further than the boundary shown by line 220. This is generally the case, even if beamforming techniques are utilized to vary the coverage pattern of the antenna array 200, since beamforming scans still operate in the perpendicular direction relative to the planar surface.

Figure 6:
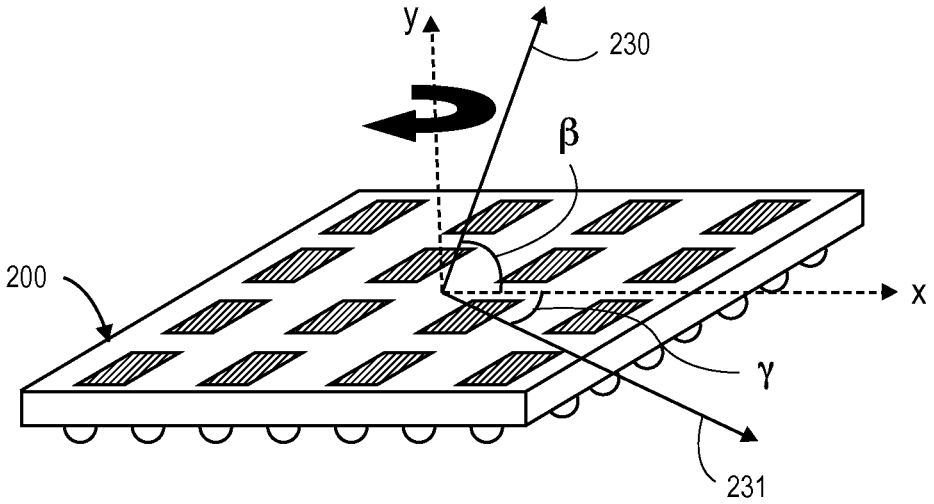
FIG. 6 is a pictorial illustration showing a more desired beam coverage from a planar antenna array structure.
Figure 7:
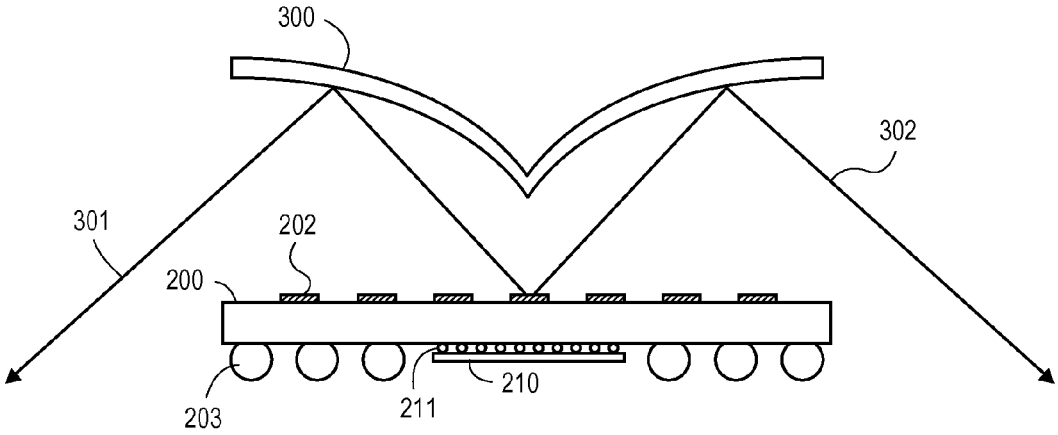
FIG. 7 illustrates one embodiment for practicing the invention, in which a reflector is positioned above a planar antenna array to redirect beam direction to obtain a more horizontal antenna coverage pattern from the planar antenna array.
Figure 8:
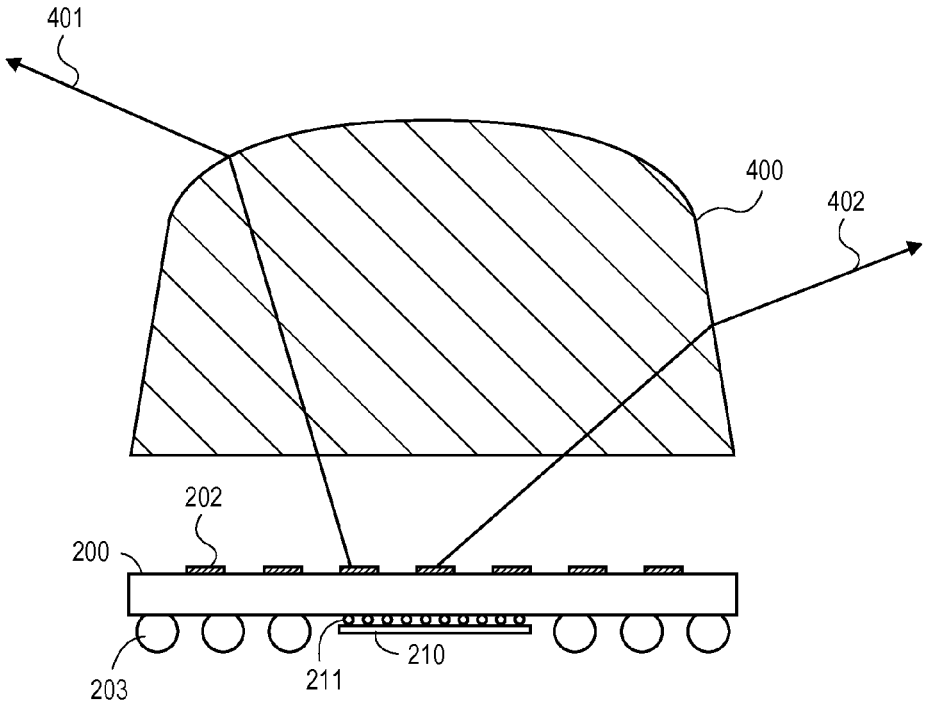
FIG. 8 illustrates one embodiment for practicing the invention, in which a refractive lens element is positioned above a planar antenna array to redirect beam direction to obtain a more horizontal antenna coverage pattern from the planar antenna array.

FIG. 6 shows an antenna coverage pattern that is more varied than the coverage provided in FIG. 5. In the example of FIG. 6, the antenna coverage is in the approximate range of −30° to +70° from the horizontal axis. The −30° angle is illustrated by angle y and the +70° angle is illustrated by angle β. Thus, with this coverage pattern, planar antenna array 200 would provide a coverage area bounded by boundary lines 230 and 231. Again, the dark rotating arrow indicates that the coverage pattern is obtained 360° about the vertical. It is evident from the illustrations of FIGS. 4 and 5, that the coverage area bounded by lines 230, 231 (approximately −30° to +70° from the horizontal axis) is not only larger in area, but provides coverage in both the horizontal and vertical directions, whereas the coverage area between axis Y and line 220 is more in the vertical direction. Accordingly, although it may not be fully omni-directional, the antenna coverage area shown in FIG. 6 is closer to providing more of an omni-directional coverage than the pattern shown in FIG. 5. FIGS. 7 and 8 illustrate two example embodiments for obtaining a more extended antenna coverage from a planar antenna array, such as planar antenna array 200.

FIG. 7 illustrates one embodiment for obtaining more horizontal coverage from planar antenna array 200, such as the coverage pattern shown in FIG. 6. In the particular example, a reflector 300 is disposed proximal and above planar antenna array 200. Reflector 300 is made from a conductive material or, alternatively, has a conductive coating, so that signals emanating from the planar antenna array 200 are reflected back towards the planar antenna array 200. Two example reflections are shown by lines 301, 302. It is understood that signals for reception by planar antenna array 200 may be reflected onto the planar antenna array along lines 301, 302, but in the reverse direction. By utilizing a reflector, such as reflector 300, antenna pattern coverage may be extended toward the horizontal direction and even below the plane of the horizontal.

Reflector 300 is shown having a gull-wing shape, but other shapes may be utilized as well. For example, concave or convex shaped designs may be utilized in other embodiments. The shape and characteristics of reflector 300 is a matter of design choice, based on the extent of the antenna coverage desired for a particular signal transmission or reception.

FIG. 8 illustrates another embodiment for obtaining a more horizontal coverage pattern from planar antenna array 200. In the particular example, a lens element 400 is disposed proximal and above planar antenna array 200. Lens element 400 is made from material that refracts signals when the signals cross the lens boundary. Two example refractions are shown by lines 401 and 402. It is also understood that signals for reception by planar antenna array 200 may be refracted onto the planar antenna array 200 along lines 401, 402, but in the reverse direction. By utilizing a refracting device, such as lens element 400, antenna coverage pattern may be extended toward the horizontal direction as well.

Lens element 400 is shown having a substantially flat surface along an edge proximal to the planar antenna array 200 and a more rounded curvature at a distal edge away from planar antenna array 200. However, the actual shape of the lens element 400 is a design choice, based on the refractive qualities desired for the signals to and from planar antenna array 200. Likewise, lens element 400 may be constructed from a variety of materials which provide refractive properties for the signal being transmitted or received by planar antenna array 200. For example, lens element 400 may be constructed from low-loss dielectric materials, glass, plastic, Teflon™ materials, as well as others. Similarly, the height of the lens element 400 will depend on the particular coverage desired. In one embodiment, lens element has a thickness of at lease 10 millimeters and covers substantially the surface area of antenna elements 202. In another embodiment, lens element 400 is approximately twice the size of the planar antenna array 200 to ensure full coverage over the antenna elements 202. Again, the actual size, shape and composition of lens element 400 is a design choice based on the particular planar antenna array used and the signals being transmitted and/or received. Furthermore, although a lens element is described herein, a variety of other types of devices that refract RF signals may be utilized in place of lens element 400 in other embodiments.

Whether a reflector or a refractor element is utilized over the planar antenna array, both of these devices operably extend the antenna pattern coverage in the horizontal direction beyond the angle a noted in FIG. 5. With sufficient consideration, the antenna pattern coverage may be extended even below the planar surface of the antenna array, as shown in FIG. 7. In one embodiment, the coverage obtained approximates the −30° to +70° coverage shown in FIG. 6.

Accordingly, the utilization of a reflector or refractor element or device allows for a more extended coverage in the horizontal direction when compared to a planar antenna array without such reflector or refractor. It is to be noted that some embodiment for practicing the invention may employ combined reflective and refractive properties in a device disposed proximally above the planar antenna array.

The reflective/refractive device that is disposed above the planar antenna array may be structurally made as part of the planar antenna array assembly or, alternatively, made as a separate component. If made part of the planar antenna array assembly, the reflective/refractive device may be mounted above the planar antenna array by some support member according to one embodiment. In another embodiment, an adhesive may be used to affix the reflector/refractor on to the planar antenna array. Still in other embodiments, the reflective/refractive device may be placed in an enclosed package.

Alternatively, the reflective/refractive device may be a separate component that is placed within a housing or enclosure that also houses the planar antenna array. For example, the planar antenna array may be mounted within a housing of a wireless apparatus and the reflective/refractive device is then attached to a portion of the enclosure that fits over the housing. Many other examples abound.

Figure 9:
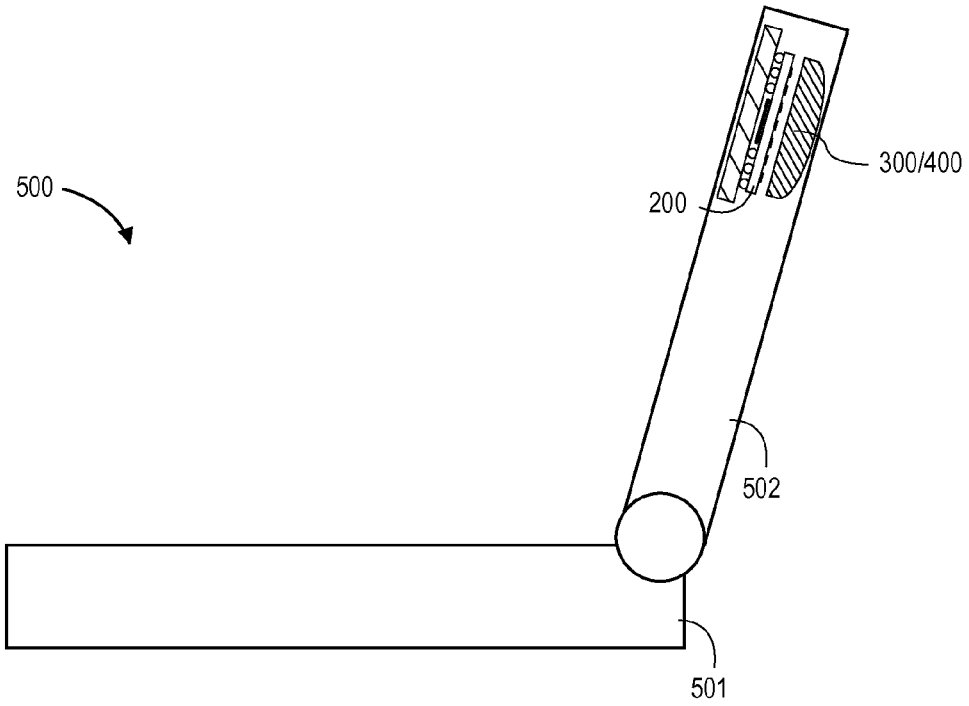
FIG. 9 illustrates a disposition of the planar antenna array assembly utilizing the lens element of FIG. 8 within a display casing portion of a notebook computer, according to one embodiment of the invention.

As a further example, FIG. 9 illustrates a notebook computer 500 that includes a housing 501 to hold the keyboard, battery, circuit boards etc. and a housing 502 that contains the display. In this example, planar antenna array 200 is placed within the housing 502, which also houses the display. Either the reflector 300 or lens element 400 is positioned over the planar antenna array 200. Note that the drawing of FIG. 9 exemplifies lens element 400, but the reflector 300 may be used as well. Reflector 300 or lens element 400 may be constructed as part of planar antenna array 200 or it may be part of, or attached to, housing 502, so that when planar antenna array 200 is placed within housing 502, reflector 300 or lens element 400 resides atop planar antenna array 200.

Figure 10:
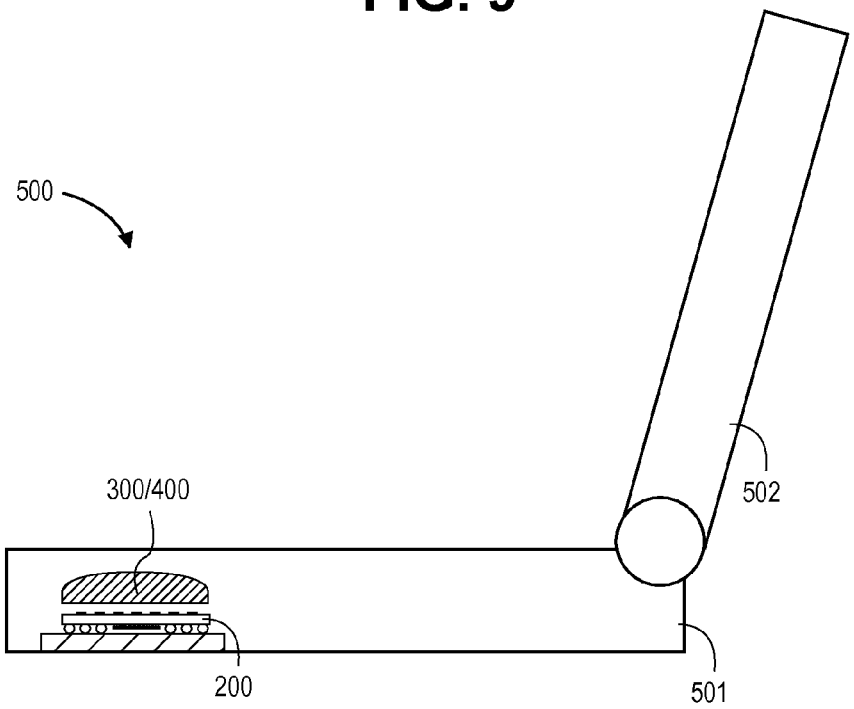
FIG. 10 illustrates a disposition of the antenna array assembly utilizing the lens element of FIG. 8 within a keyboard casing portion of a notebook computer, according to one embodiment of the invention.
Figure 11:
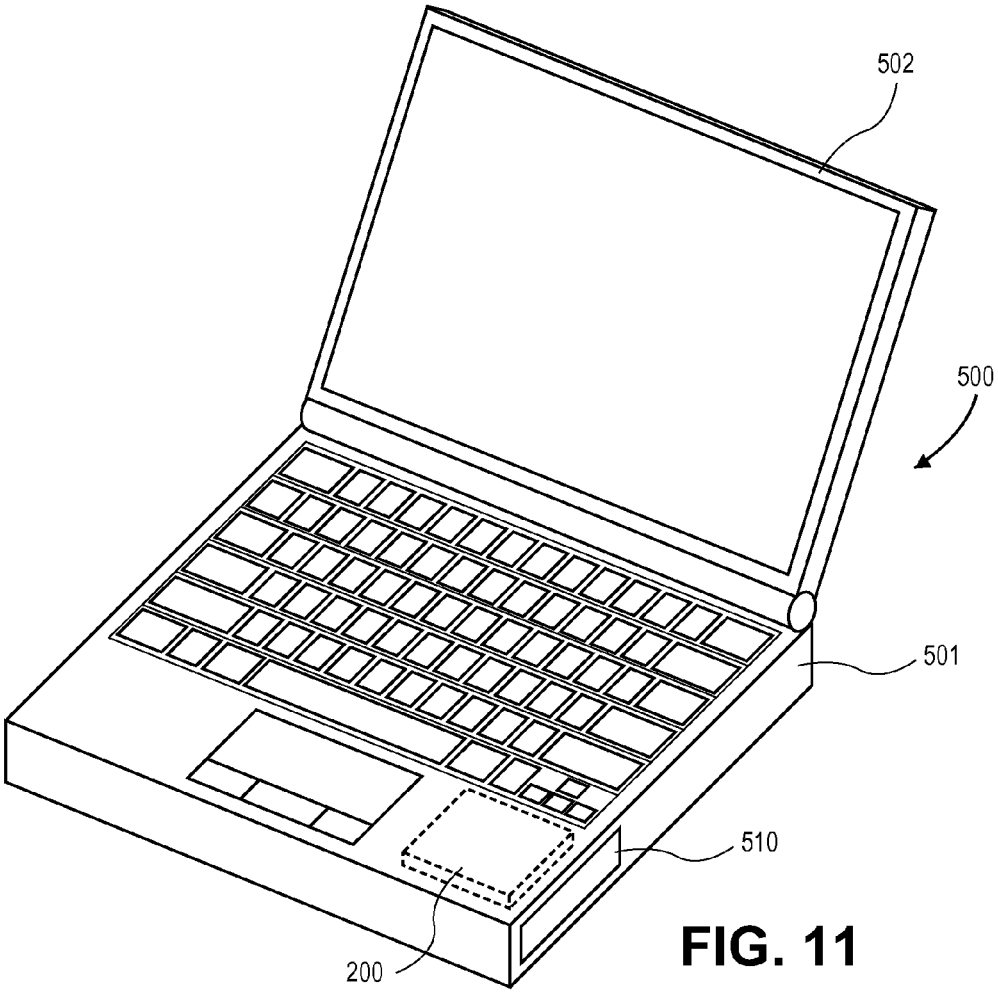
FIG. 11 is a pictorial diagram illustrating a disposition of the planar antenna array assembly within the keyboard casing portion of the notebook computer, according to one embodiment of the invention.

In another example, planar antenna array 200, with reflector 300 or lens element 400, is placed within housing 501. An example of such placement is shown in FIG. 10. Again, reflector 300 or lens element 400 may be constructed as part of planar antenna array 200 or it may be part of, or attached to, housing 501, so that when planar antenna array 200 is placed within housing 501, reflector 300 or lens element 400 resides atop planar antenna array 200. One advantage of utilizing the arrangement shown in FIG. 10 is that assembly containing planar antenna array 200 and IC 201 is much closer to the computer circuitry housed within housing 501, so that electrical connections between IC 201 and the computer circuitry may be minimized. FIG. 11 shows a pictorial illustration of the one example embodiment of FIG. 10, in which planar antenna array 200 is mounted within housing 501 of notebook computer 500.

Although the planar antenna array 200 is mounted flat within housing 501, the presence of reflector 300 or lens element 400 allows antenna coverage along the horizontal direction. In some instances where the housing is made from a metallic material that inhibits passage of wireless signals, an aperture 510 may be placed along the side of the housing 501 to allow passage of wireless signals. Since horizontal coverage is available from planar antenna array 200, signal coverage is maintained by planar antenna array 200 in this instance through aperture 510.

Figure 12:
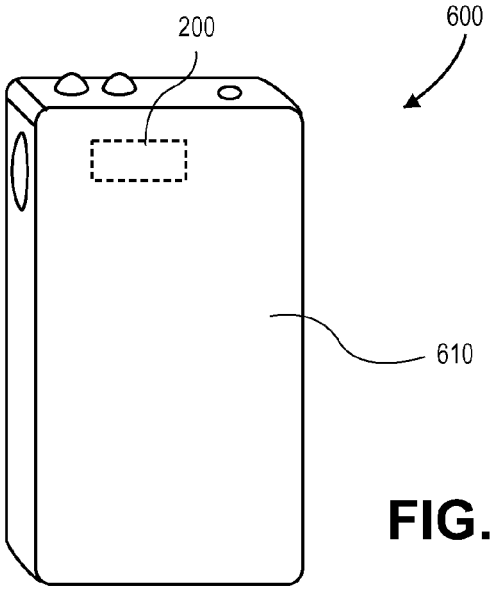
FIG. 12 is a pictorial diagram illustrating a disposition of the planar antenna array assembly within a mobile handheld device according to one embodiment of the invention, according to one embodiment of the invention.

Likewise, planar antenna array 200 may be utilized with other wireless devices as well. FIG. 12 shows a handheld wireless device 600, such as a media player, smartphone, etc. that incorporates planar antenna array 200 within its housing 610. An aperture may be used as well, if needed due to the construction material of the housing.

Accordingly, a variety of devices may incorporate the planar antenna array 200 with the accompanying reflector 300 or lens element 400. The presence of reflector 300 or lens element 400 above planar antenna array 200 allows for a more wider coverage by the planar antenna array 200. In some instances, such wider coverage allows the planar antenna array 200 to be placed at certain locations, which would not be possible if the wider coverage was not present. Such configuration may reduce cost and/or reduce implementation complexity, thereby enhancing the performance of the platform containing the planar antenna array.

As may be used herein, the terms "substantially" and "approximately" provides an industry-accepted tolerance for its corresponding term and/or relativity between items. Such an industry-accepted tolerance ranges from less than one percent to fifty percent. Such relativity between items ranges from a difference of a few percent to magnitude differences. As may also be used herein, the term(s) "coupled" and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" indicates that an item includes one or more of power connections, input(s), output(s), etc., to perform one or more its corresponding functions and may further include inferred coupling to one or more other items.

The embodiments of the present invention have been described above with the aid of functional building blocks illustrating the performance of certain functions. The boundaries of these functional building blocks have been arbitrarily defined for convenience of description.

Alternate boundaries could be defined as long as the certain functions are appropriately performed. One of ordinary skill in the art may also recognize that the functional building blocks, and other illustrative blocks, modules and components herein, may be implemented as illustrated or by discrete components, application specific integrated circuits, processors executing appropriate software and the like or any combination thereof.

We claim:

1. An apparatus comprising:

a planar antenna array having a plurality of antenna elements disposed on a planar surface of a substrate, in which a coverage pattern of the antenna elements is directed approximately in a direction perpendicular to the planar antenna array;

a reflector disposed proximal and above the planar antenna array to reflect radio frequency signals to extend the coverage pattern of the antenna elements in a direction away from the direction perpendicular to the planar antenna array; and an integrated circuit disposed on an opposite side of the substrate from the planar antenna array and configured to operate with the planar antenna array.

2. The apparatus of claim 1, wherein the planar antenna array and the reflector are attached together as one unit.

3. The apparatus of claim 1, wherein the planar antenna array is mounted in a housing and the reflector is disposed as part of the housing.

4. The apparatus of claim 1, wherein the planar antenna array and the reflector are mounted in a housing of a mobile computing device.

5. The apparatus of claim 1, wherein the planar antenna array and the reflector are mounted in a handheld wireless device.

6. The apparatus of claim 1, wherein the integrated circuit includes a radio frequency front-end and a baseband module.

7. The apparatus of claim 6, wherein a connection of the integrated circuit to the planar antenna array is through the substrate.

8. An apparatus comprising:

a planar antenna array having a plurality of antenna elements disposed on a planar surface of a substrate, in which a coverage pattern of the antenna elements is directed approximately in a direction perpendicular to the planar antenna array;

a lens element disposed proximal and above the planar antenna array to refract radio frequency signals to extend the coverage pattern of the antenna elements in a direction away from the direction perpendicular to the planar antenna array; and an integrated circuit disposed on an opposite side of the substrate from the planar antenna array and configured to operate with the planar antenna array.

9. The apparatus of claim 8, wherein the planar antenna array and the lens element are attached together as one unit.

10. The apparatus of claim 8, wherein the planar antenna array is mounted in a housing and the lens element is disposed as part of the housing.

11. The apparatus of claim 8, wherein the planar antenna array and the lens element are mounted in a housing of a mobile computing device.

12. The apparatus of claim 8, wherein the planar antenna array and the lens element are mounted in a handheld wireless device.

13. The apparatus of claim 8, wherein the integrated circuit includes a radio frequency front-end and a baseband module.

14. The apparatus of claim 13, wherein a connection of the integrated circuit to the planar antenna array is through the substrate.

15. A method comprising:

utilizing a planar antenna array having a plurality of antenna elements disposed on a planar surface of a substrate, in which a coverage pattern of the antenna elements is directed approximately in a direction perpendicular to the planar antenna array;

reflecting or refracting radio frequency signals by use of a reflector or a lens element disposed proximal and above the planar antenna array to extend the coverage pattern of the antenna elements in a direction away from the direction perpendicular to the planar antenna array; and utilizing an integrated circuit disposed on an opposite side of the substrate from the planar antenna array, in which the integrated circuit is configured to operate with the planar antenna array.

16. The method of claim 15, wherein the radio frequency signals are reflected by use of a reflector disposed above the planar antenna array.

17. The method of claim 15, wherein the radio frequency signals are refracted by use of a lens element disposed above the planar antenna array.

18. The method of claim 15, wherein the coverage pattern is extended below the planar surface of the planar antenna array.

19. The method of claim 15, wherein the coverage pattern is extended from approximately 70° above the planar surface of the planar antenna array to approximately 30° below the planar surface of the planar antenna array.

20. The method of claim 15, wherein when utilizing the integrated circuit, the integrated circuit is configured to operate with the planar antenna array via a connection through the substrate.

* * * * *